United States Patent [19]

McMahan

[11] 4,084,080

[45] Apr. 11, 1978

[54] TOWEL HEATER AND DISPENSER

[76] Inventor: William T. McMahan, 7533 Ontario, Burbank, Calif. 91505

[21] Appl. No.: 727,471

[22] Filed: Sep. 28, 1976

[51] Int. Cl.[2] ..... F27D 11/02

[52] U.S. Cl. ..... 219/401; 21/81; 21/94; 122/459; 126/369; 219/386; 219/432; 219/436; 219/521

[58] Field of Search ..... 219/272, 275, 284, 365, 219/385, 386, 400, 401, 430, 432, 438, 439, 441, 521, 523, 435, 436; 21/81, 94, 95, 102 R; 34/200, 242; 68/5 R; 99/341, 440; 126/273, 20, 369; 122/459

[56] References Cited

U.S. PATENT DOCUMENTS

| | | | |
|---|---|---|---|
| 1,047,668 | 12/1912 | Madonna | 21/81 X |
| 2,443,321 | 6/1948 | Miner, Jr. | 68/5 R |
| 2,454,602 | 11/1948 | Gunther | 21/95 X |
| 2,458,757 | 1/1949 | Woehrel | 21/81 |
| 2,601,850 | 7/1952 | Ames | 126/369 |
| 2,715,999 | 8/1955 | Michaelis et al. | 126/273 |
| 2,818,794 | 1/1958 | Aslesen | 99/341 |
| 3,347,618 | 10/1967 | McKeown | 21/94 |
| 3,609,297 | 9/1971 | Christopoulos | 219/439 |
| 3,754,118 | 8/1973 | Booker | 219/523 |
| 3,902,044 | 8/1975 | Doyle et al. | 219/401 X |

FOREIGN PATENT DOCUMENTS

| | | | |
|---|---|---|---|
| 521,957 | 8/1953 | Belgium | 219/401 |
| 490,335 | 8/1938 | United Kingdom | 21/81 |
| 836,592 | 6/1960 | United Kingdom | 219/401 |

*Primary Examiner*—Volodymyr Y. Mayewsky
*Attorney, Agent, or Firm*—Roger A. Marrs

[57] ABSTRACT

An apparatus for the heating, moistening and holding cosmetic towels or the like is disclosed herein having a box-like support into which a water tray is placed. Legs are carried underneath the tray for holding the tray in spaced relationship with respect to the bottom of the support. A heater coil is downwardly suspended from the tray in the space and the heater coil terminates in a pronged electrical connection for detachably receiving an electrical plug attached to a conventional source of AC line voltage. The water tray holds a small quantity of water and, in turn, supports a removable perforated table which supports the towels. The sidewall of the water tray upwardly project beyond the towel surface of the perforated table and the sidewall of box-like support. A removable lid completes the device so that steam produced by the heated water is captured in the device for heating and moistening the towels.

1 Claim, 4 Drawing Figures

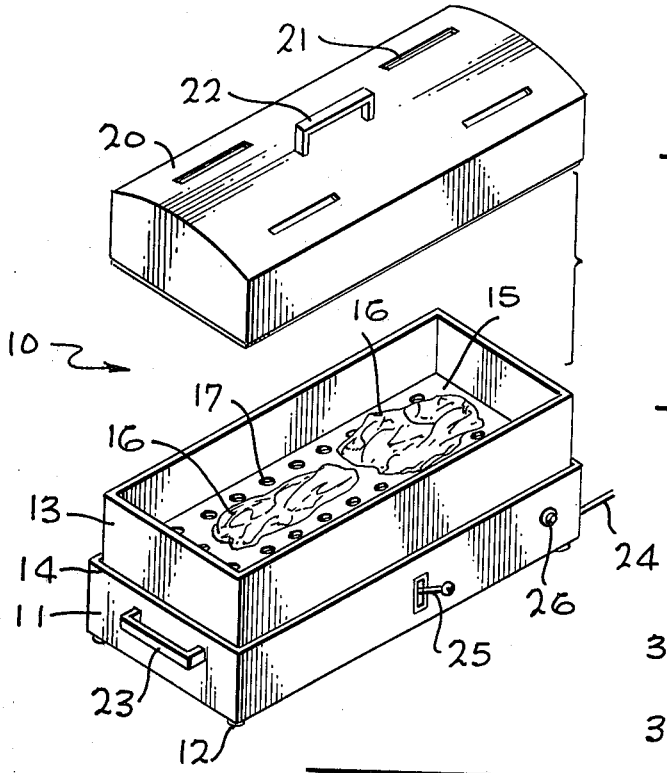
Fig. 1
Fig. 3
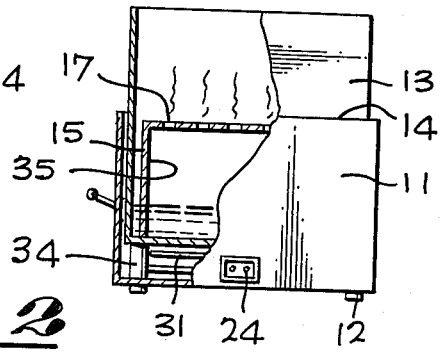
Fig. 2
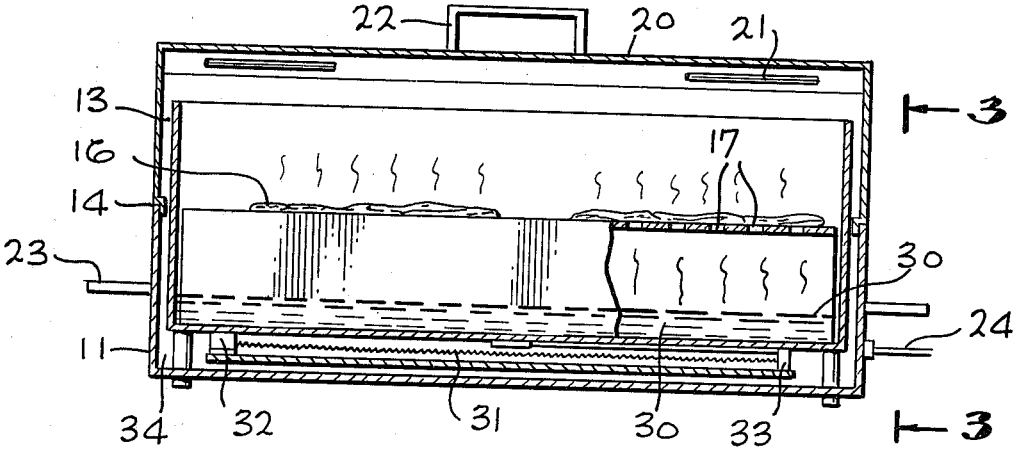
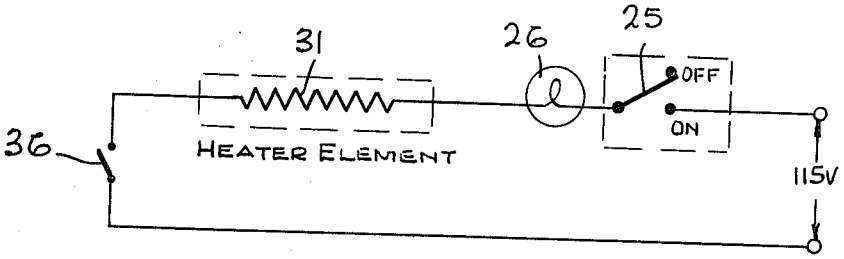
Fig. 4

TOWEL HEATER AND DISPENSER

BACKGROUND OF THE INVENTION

1. Field of the Invention

This invention relates a cosmetic towel moistening and heating device and more particularly, to a such device having a novel nesting of consonent elements so that steam is properly maintained in the immediate vicinity of the towels.

2. Brief Description of the Prior Art

In the past, it has been the conventional practice to heat and moisten towels to be used in the procedure of shaving. The moist and heated towels are generally used by placing the towel over the face of a person having been shave so as to remove shaving cream, maintain the skin moist and to provide the comfort of heat to the skin. In some instances, the barber or cosmetician will take a dry towel and place the towel under a source of heated water followed by wringing the towel to substantially remove the water and then applying the heated and moist towel to the face of a person having been shaved. This procedure is time consuming and does not provide a supply of moistened and heated towels which may be used at random.

Some attempts have been made to use electric heating devices which will support a towel and moisten and heat the towel until ready for use. Such devices are shown in U.S. Pat. Nos. 2,980,099, 2,230,245 and 3,646,316. Although these devices are useful for their intended purposes, the devices are not adequate for holding a substantial supply of towels in readiness for use while being moist and heated and furthermore, do not provide for a nested arrangement of components such that the water tray, perforated table supporting the towels and the overall case or support maybe readily separated from one another in a convenient manner. Also, no means are provided for indicating that the device is in operation and that towels are in readiness for use. Additionally, no means is employed for regulating the temperature and for insuring that the towels are of adequate temperature so that the user is not burned or otherwise injured.

Therefore, a long standing need has been present to provide a novel device or apparatus for moistening and heating towels which provides a novel arrangement of nesting the components together so that ready access may be had to determine water level, towel temperature and maintenance of steam within the enclosure.

SUMMARY OF THE INVENTION

Accordingly, the above problems and difficulties are obviated by the present invention which provides a novel arrangement of component parts and elements consisting of a support frame of box-like construction which supports a water tray within the confines of the supports sidewall. The water tray is held in fixed spaced apart relationship on the bottom of the support by means of a plurality of legs carried on the underside of the tray. In addition to the legs, an electrical heating element is downwardly suspended from beneath the tray within the space defined by the space relationship of the tray with respect to the bottom of the support. A small quantity of water is maintained within the tray and the tray further supports a perforated table for holding a plurality of towels intended to be moistened and heated. The perforated table includes downwardly depending legs which maintain the towels out of contact with the small quantity of water held in the tray. The sidewall of the water tray extends upward beyond the periphery of the surface of the perforated table supporting the plurality of towels and a removable lid is carried on the edge marginal region of the support frame for capturing steam generated by the heating of the water. The lid is provided with a plurality of vents to permit escaping steam so that a steam head or pressure does not build within the device.

Therefore, it is among the primary object of the present invention to provide a novel towel moistening and heating device having a plurality of components which are nested together to permit easy access to water trays, towel supports and to electrical components.

Another object of the present invention is to provide a novel towel and moistening and heating device which is inexpensive to manufacture and which may be used by unskilled persons.

Still another object of the present invention is to provide a novel towel moistening and heating apparatus which includes adaquate controls for steam heating towels to a preferred temperature and which controls further include an adjustable means for setting the desired temperature.

A further object of the present invention is to provide a novel apparatus for heating and moistening towels for cosmetic purposes wherein steam heat is employed under controllable conditions such that pressure buildup is avoided and so that the steam may be readily circulated within the device for thoroughly and rapidly heating towels.

BRIEF DESCRIPTION OF THE DRAWINGS

The features of the present invention which are believed to be novel are set forth with particularily in the appended claims. The present invention, both as to its organization and manner of operation, together with further objects and advantages thereof, may best be understood by reference to the following description, taken in connection with the accompanying drawings in which:

FIG. 1 is an exploded perspective view of the novel towel moistening and heating apparatus of the present invention illustrating a typical application thereof;

FIG. 2 is an enlarged longitudinal view of the towel moistening and heating apparatus shown in FIG. 1;

FIG. 3 is an end elevational view, partially broken away, illustrating the device shown in FIG. 2 as taken in the direction of arrows 3—3 thereof; and FIG. 4 is a schematic drawing of the electrical circuit incorporated into the heating means used in the device of FIGS. 1-3 inclusive.

DESCRIPTION OF THE PREFERRED EMBODIMENT

Referring to FIG. 1, the novel towel moisture and heating device of the present invention as illustrated in the general direction of arrow 10. The device includes a frame support 11 of box-like construction having a continuous sidewall arranged around the edge of a bottom. The bottom may support a plurality of legs such as is indicated by numeral 12 for the purpose of elevating the frame support above the working surface. The open cavity defined by the opposing interwall surfaces of the continuous sidewall is occupied by a water tray 13 having a bottom for supporting a continuous sidewall around its peripheral. The water tray is arranged so as to nest within the cavity defined by the imposing sidewall of the frame support 11. It is to be particularly noted that the sidewall 13 extends substantially above the top edge, identified by numeral 14 of the sidewall 11. Within the interior of the water tray 13, there is provided, a removable perforated table 15 on which a plurality of towels 16 or the like may be supported. The towels 16 are articles intended to be heated and moisturized and these items are further intended to be stored until ready for use within the moist and heated environment of the water tray. The plurality of perforations, indentified by numeral 17 permit steam from water carried in the tray 13 to rise from the super heated water and permeate the compartment or area immediately above the perforated table 15 so that the towels 16 are surrounded by the moist nd heated environment. To complete the compartment, a lid 20 is removably carried about the sidewall of water tray 13 so that the steam is captured under the lid. However, a plurality of slots such as slot 21 are formed in the lid so that a steam head or pressure buildup will not occur. Preferably, the lid 20 includes a handle 22 for assisting the user in lifting the lid from the device when a body of the lid is heated due to the steam underneath. It is also to be noted that the support frame 11 may include a handle 23 which is repeated on the opposite end of the device to assist in carrying the device from one location to another. Also, the water is heated by an electrical resistance heating element and the element is attached to conventional AC line power via a plug and cord 24. An on-off switch 25 is employed for controlling the device and the resistance heating element in particular while a light 26 visually indicated the on or off condition of the heating element.

Referring now in detail to FIG. 2, it can be seen that the water tray 13 supports a small quantity of water indicated by numeral 30 and that the water is heated via an electrical heat resistance element 31 such as a spring, rod or coil. The element 31 is carried under the bottom of the water tray 13 and is downwardly suspended therefrom by attachment elements 32 and 33. It is also to be understood that the bottom of tray 13 is arranged in fixed spaced relationship with respect of bottom of frame support 11 by means of legs 34 arranged at each corner of the tray. The resistance heating element is located within the space defined between the opposing surfaces of the bottom of tray 13 and the bottom of tray or frame support 11. This figure further illustrates that the lid 20 is supported on the device by a mating arrangement of the edge marginal region of the sidewall of the lid with the top edge 14 of the frame support 11.

Referring now in detail to FIG. 3, it can be seen that the component parts of the device 10 are nested together so that one component fits within the other and so that the component parts may be readily removed by lifting the component upward out of its support on the under component. For example, the perforated table 15 may be readily removed by lifting the table out of its support on the tray 13. The table 15 includes a pair of downwardly depending legs 35 which extend through the water 30 and rest on the bottom of tray 13. In turn, the tray 13 may be readily removed by lifting the tray upward so that the legs 34 disengage with the frame support 11.

in FIG. 4, an electrical circuit is illustrated for controlling the temperature of the device. The heater element 31 is heated by introducing electricity thereto from line voltage by closing switch 25. When the heating element has been heated for a period of time, the thermocouple 36 will open and remove the electricity from the heater element so that the compartment in the device will not attain further heat. The light 26 will visually indicate the cycling of the heating on and off even though the switch 25 is in its on condition.

In view of the foregoing, it can be seen that the moistening and heating device of the present invention provides a novel arrangement of component parts whereby ready access is made to each of the parts by virtue of the nesting arrangement of the component parts. Furthermore, the lid may be readily removed and access may be had to the articles intended to be moisturized and heated which are resting on the perforated table 15. Water may be readily introduced into the water tray 13 by either removing the table 15 or by pouring water over the table so that the water will enter the tray around the legs 35 of the table or through the apertures 17. During the heating process, the water 30 may be raised to the temperature of boiling whereas the thermocouple 36 will open and no further heat will be produced. This prevents unnecessary evaporation of the water and it maintains a relatively constant temperature within the heating compartment or chamber immediately surrounding the articles 16. The device is relatively small in size and may be maintained as a bathroom or washroom accessory as well as maintained in a professional barber or cosmetics shop.

While particular embodiments of the present invention have been shown and described, it will be obvious to those skilled in the art that changes and modifications may be made without departing from this invention in its broader aspects, and, therefore, the aim in the appended claims is to cover all such changes and modifications as follow within the true spirit and scope of this invention.

What is claimed is:

1. Apparatus for moistening and heating a towel preparatory for placement against the skin of a user, the combination comprising:

a support frame of box-like construction having a continuous sidewall carried about the periphery of a bottom so as to define an open cavity between the opposing wall surfaces of said sidewall;

a water tray removably carried within said support frame open cavity and havving a continuous sidewall carried about the periphery of a bottom and said tray bottom arranged in spaced apart relationship with respect to said support frame bottom;

an electrical heating element disposed in said space defined between said tray bottom and said support frame bottom;

a perforated table removably disposed in said water tray having a perforated surface elevated about a quantity of water carried on said tray bottom;

control means operably coupled to said electrical heating element for energizing said element for heating said water in said tray so as to create steam about said perforated table;

a vented lid detachably carried on the exposed edge of said support frame sidewall to close said open cavity whereby steam is maintained under said lid;

the height of said tray continuous sidewall is substantially greater than the height of said support frame continuous sidewall;

said water tray includes a plurality of legs arranged at the respective corners thereof for supporting said tray on said support frame and for defining said space between said support frame bottom and said water tray bottom;

said perforated table, said water tray and said support frame are of respective diminishing size so as to provide a nested relationship one within the other;

said water tray further includes mounting means downwardly suspending said heating element from said water tray bottom within said defined space;

said perforated table is on U-shaped cross section incorporating a pair of legs downwardly depending from the opposite side edges of said perforated surface;

said control means further includes a thermocouple connected in series with said switch operable in response to steam temperature to interrupt said circuit; and a light coupled in said circuit for visually indicating energization of said circuit.

* * * * *